US007707946B2

(12) United States Patent
Lima

(10) Patent No.: US 7,707,946 B2
(45) Date of Patent: May 4, 2010

(54) ADJUSTABLE WORK SURFACE SUPPORT

(75) Inventor: Jose M. Lima, Cambridge (CA)

(73) Assignee: Baral Holdings Corp., Kitchener (CA)

( * ) Notice: Subject to any disclaimer, the term of this patent is extended or adjusted under 35 U.S.C. 154(b) by 0 days.

(21) Appl. No.: 10/975,538

(22) Filed: Oct. 29, 2004

(65) Prior Publication Data

US 2005/0092216 A1 May 5, 2005

Related U.S. Application Data

(60) Provisional application No. 60/515,645, filed on Oct. 31, 2003.

(51) Int. Cl.
*A47F 5/12* (2006.01)

(52) U.S. Cl. ..... 108/7; 108/10; 248/284.1

(58) Field of Classification Search ..... 108/6–10, 108/71–72, 95–96, 106, 50.01; 248/282.1, 248/283.1, 118.3, 284.1; 312/223.3
See application file for complete search history.

(56) References Cited

U.S. PATENT DOCUMENTS

| | | | |
|---|---|---|---|
| 4,496,200 | A | 1/1985 | Hagstrom et al. |
| 4,616,798 | A | 10/1986 | Smeenge et al. |
| 4,625,657 | A | 12/1986 | Little et al. |
| 4,635,893 | A | 1/1987 | Nelson |
| 4,644,875 | A | 2/1987 | Watt |
| 4,691,888 | A | 9/1987 | Cotterill |
| 4,706,919 | A | 11/1987 | Soberalski et al. |
| 4,776,284 | A | 10/1988 | McIntosh |
| 5,031,867 | A | 7/1991 | Cotterill |
| 5,037,054 | A | 8/1991 | McConnell |
| 5,145,136 | A | 9/1992 | McConnell |
| 5,211,367 | A | 5/1993 | Musculus |
| 5,230,289 | A | 7/1993 | George et al. |
| 5,257,767 | A | 11/1993 | McConnell |
| 5,292,097 | A | 3/1994 | Russell |

(Continued)

FOREIGN PATENT DOCUMENTS

| | | |
|---|---|---|
| CA | 2174345 | 2/1996 |

(Continued)

OTHER PUBLICATIONS

Canadian Intellectual Property Office, Office Action for corresponding CA Appln. No. 2,544,001, Sep. 15, 2008.

*Primary Examiner*—Hanh V Tran
(74) *Attorney, Agent, or Firm*—Borden Ladner Gervais LLP; Jeffrey W. Wong

(57) ABSTRACT

An adjustable work surface support for use with a primary work surface and a secondary work surface comprising primary work surface connector; secondary work surface connector; a parallelogram link support comprising a support bar mounted to the primary work surface connector to define a first axis; and a pair of parallel arms, each arm attached at one end to the support bar and a second end attached to the secondary work surface connector to define a second axis; a connecting plate; attached adjacent one of the parallel arms to the primary and secondary work surface connector; having a first pivot point rotatable about the first axis and a second pivot point being rotatable about the second axis; such that when the arm is pivoted about the first axis, an angular position of the secondary work surface with respect to the primary work surface is substantially constant.

7 Claims, 6 Drawing Sheets

U.S. PATENT DOCUMENTS

| | | | |
|---|---|---|---|
| 5,398,622 | A | 3/1995 | Lubinskas et al. |
| 5,513,579 | A | 5/1996 | Allan |
| 5,522,323 | A | 6/1996 | Richard |
| 5,626,323 | A | 5/1997 | Lechman et al. |
| 5,653,413 | A | 8/1997 | Fink |
| 5,683,064 | A | 11/1997 | Copeland et al. |
| 5,685,235 | A | 11/1997 | Allan |
| 5,697,303 | A | 12/1997 | Allan |
| 5,704,299 | A | 1/1998 | Corpuz et al. |
| 5,707,034 | A | 1/1998 | Cotterill |
| 5,775,657 | A | 7/1998 | Hung |
| 5,791,263 | A | 8/1998 | Watt et al. |
| 5,823,487 | A | 10/1998 | Kirchhoff et al. |
| 5,836,560 | A | 11/1998 | Kaplan et al. |
| 5,839,373 | A | 11/1998 | Lin |
| 5,878,674 | A | 3/1999 | Allan |
| 5,924,664 | A | 7/1999 | Mileos et al. |
| 5,992,810 | A | 11/1999 | Crinion et al. |
| 6,098,935 | A | 8/2000 | Kaplan et al. |
| 6,135,404 | A | 10/2000 | Wisniewski et al. |
| 6,135,405 | A | 10/2000 | Jones et al. |
| 6,158,359 | A | 12/2000 | Allan et al. |
| 6,227,508 | B1 | 5/2001 | Panzarella et al. |
| 6,257,538 | B1 | 7/2001 | Pangborn et al. |
| 6,296,215 | B1 | 10/2001 | McCoy et al. |
| 6,397,763 | B1 * | 6/2002 | Panzarella et al. ..... 248/284.1 |
| 6,488,248 | B1 | 12/2002 | Watt et al. |
| 6,565,056 | B2 | 5/2003 | Lin |
| 7,013,813 | B2 * | 3/2006 | Lima et al. ..... 108/10 |
| 2003/0178541 | A1 | 9/2003 | Barber |

FOREIGN PATENT DOCUMENTS

| | | |
|---|---|---|
| EP | 592 181 A2 | 4/1994 |
| EP | 0984712 B1 | 3/2000 |
| WO | WO 93/25117 | 12/1993 |
| WO | WO 96/05754 | 2/1996 |
| WO | WO 98/53721 | 12/1998 |

* cited by examiner

ADJUSTABLE WORK SURFACE SUPPORT

CROSS REFERENCE TO RELATED APPLICATIONS

This application claims the benefit of U.S. Provisional Application No. 60/515,645, filed Oct. 31, 2003, which is incorporated herein by reference.

FIELD OF THE INVENTION

The invention relates generally to adjustable work surfaces. More particularly, the invention relates to an adjustable work surface support mechanism for mounting a secondary work surface to a primary work surface.

BACKGROUND OF THE INVENTION

In the field of traditional support mechanisms, there are many different types of adjustable work surface support mechanisms, such as the one described in U.S. Pat. No. 5,513,579 to Allan. However, such support mechanisms generally require a large number of individual parts, making it expensive to manufacture and assemble.

Furthermore, there are other support mechanisms which are used in computer desks. The support mechanisms allow an adjustable secondary work surface, which generally holds a keyboard, to be manually moved from a first position to a second position in the vertical direction, in reference to a primary work surface which holds a computer monitor. However, many of these support mechanisms include parts underneath the secondary work surface which may cause injury when a user's legs coming into contact against it or a user's hands when they try to adjust the height of the secondary work surface.

It is, therefore, desirable to provide an adjustable work surface support which overcomes some of the problems of the prior art.

SUMMARY OF THE INVENTION

It is therefore an object of the invention to provide an adjustable work surface support mechanism which provides a robust support, which can be easily and repeatably pivoted so that a secondary work surface may be moved with respect to a primary work surface, while keeping the construction simple and more cost effective to manufacture and assemble.

In one aspect of the present invention, there is provided an adjustable work surface support for use with a primary work surface and a secondary work surface comprising primary work surface connecting means; secondary work surface connecting means; a parallelogram link support comprising a pair of parallel arms, each arm attached at one end to the primary work surface connecting means to define a first axis and a second end attached to the secondary work surface connecting means to define a second axis; a connecting plate; attached adjacent one of the parallel arms to the primary and secondary work surface connecting means; having a first pivot point rotatable about the first axis and a second pivot point being rotatable about the second axis; such that when the arm is pivoted about the first axis, an angular position of the secondary work surface with respect to the primary work surface is substantially constant.

The brake system is advantageously operated using a remote control mechanism, which advantageously is arranged inside the hollow arm.

The remote control mechanism has a movement transmitting means, which advantageously is arranged inside the hollow arm.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

Figure 1:
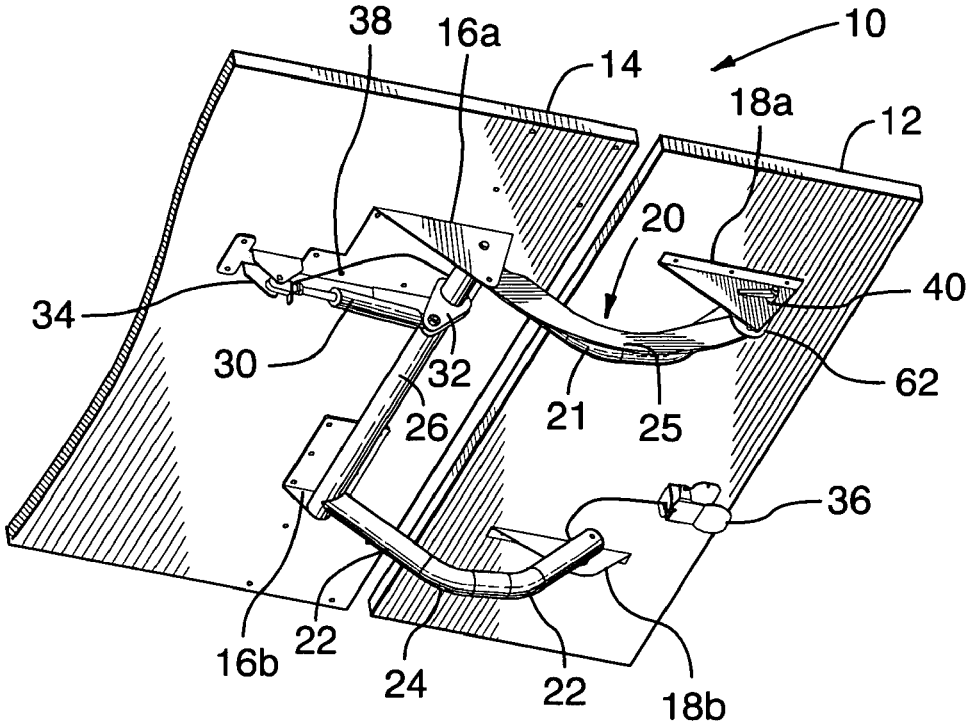
FIG. 1 is a perspective view of an adjustable work surface support in accordance with an embodiment of the present invention.

Generally, the invention is directed at an adjustable work surface support 10 , or mechanism, for mounting a secondary work surface 12 to a primary work surface 14. The adjustable work surface support 10 allows for a vertical pivoting movement of the secondary work surface 12 relative to the primary work surface 14.

The work surface support 10 comprises a primary work surface connecting means, seen in the present embodiment as a pair of mounting brackets 16 (seen as brackets 16*a* and 16*b*) which are used to attach the support 10 to the primary work surface 14. A secondary work surface connecting means, seen as a second pair of mounting brackets 18 (seen as brackets 18*a* and 18*b*) attach the work surface support 10 to the secondary work surface 12. The mounting brackets 16 and 18 are both attached to a parallelogram link support, which in the preferred embodiment is a tubular substantially U-shaped double arm support 20 with one arm 21*a* connected at each end to brackets 16*a* and 18*a* and the other arm 21*b* connected at each end to brackets 16*b* and 18*b*.

The double arm support 20 comprises a support bar or cross-bar 26, which is mounted at each end to one of the first mounting brackets 16*a* and 16*b* and the two substantially parallel arms 21 extending from the cross-bar 26. The double arm support 20 is preferably constructed as a one-piece tubular construction, with the arms 21 formed integral with the cross-bar 26 in order to provide further support to the primary and secondary work surfaces 14 and 12 and to lower the number of parts required for the work surface support 10.

The two arms 21 attach to the secondary work surface 12 via the pair of second mounting brackets 18*a* and 18*b*. The cross-bar 26 defines a first axis about which the work surface support 10 rotates and while the attachment of the arms to the secondary work surface connecting means defines a second axis of rotation.

The shape of the arms 21 is preferably U-shaped with edge sections 22 of each arm 21 at an angle from a bottom section 24 in the preferred embodiment. The angles at which the edge sections 22 are angled from the bottom section 24 are selected to provide clearance under the work surfaces full sweep (or range of motion) of the secondary work surface. Adjacent and parallel to one of the arms 21*a* is a connecting plate 25 which is used to maintain the parallelism between the two work surfaces 12 and 14 when the secondary work surface 12 is in the default position (not tilted).

The double arm support 20 provides the mechanism for the secondary work surface 12 to move relative to the primary work surface 14 as will be described below.

The work surface support 10 also comprises a brake mechanism 30 which allows a user to release and lock the position of the secondary work surface 12. The brake mechanism comprises a brake attachment mechanism 32 and is mounted to the primary work surface 14 via a brake mechanism mounting means, seen as a mounting bracket in the Figures. In the preferred embodiment, the brake mechanism is a gas cylinder actuated cable system.

When the brake mechanism is disengaged or released, the work surface support 10 is allowed to rotate about the first axis defined by the cross-bar 26. When engaged or locked, the brake mechanism 30 securely holds the cross-bar 26 and the arms 21 in a locked position relative to the primary work surface 16 via a first brake mechanism attachment 32 arranged on the cross-bar 26. The brake mechanism 30 is preferably actuated via a remote control mechanism 36 which is attached to the secondary work surface 12, so that a user can easily engage and disengage the brake mechanism 30 to adjust the vertical position of the secondary work surface 12 (via the support 20) relative to the primary work surface 14 from a level position (where the surface of the secondary work surface 12 is in the same plane as the surface of the primary work surface 14) to a lowered position (where the surface of the secondary work surface 12 is lower than the surface of the primary work surface 14) or a raised position (where the surface of the secondary work surface 12 is above surface of the primary work surface 14) as the need of the user dictates. It will be understood that there are numerous raised and lowered positions since the position of the secondary work surface 12 with respect to the primary work surface 14 is defined by the user. In the present embodiment, the remote control mechanism 36 is a pedal connected to the brake mechanism 30 via a cable 38, or other movement transmitting means. The cable 30 is preferably located within one of the arms 21 so that it does not interfere with any objects underneath the work surfaces, to avoid entanglement and possible injury to the user's legs and to protect the cable 38 from being damaged.

As discussed above, the secondary work surface connecting means, or the second pair of mounting brackets 18*a* and 18*b*, defines a second axis about which the double arm support 20 rotates so that the secondary work surface 12 may move to any position desired by the user. A tilting mechanism 40 holds the secondary work surface 12 in a desired tilted position when the tilting mechanism 40 is in its locked position and permits a pivoting movement of the secondary work surface when the tilting mechanism 40 is in a released position thereby allowing the angle of the surface of the secondary work surface 12 to be changed. The tilting mechanism 40 is preferably a friction-friction lock, however, other types of locks such as a spin knob lock, friction brake mechanisms and ratchet mechanisms are contemplated.

Figure 2:
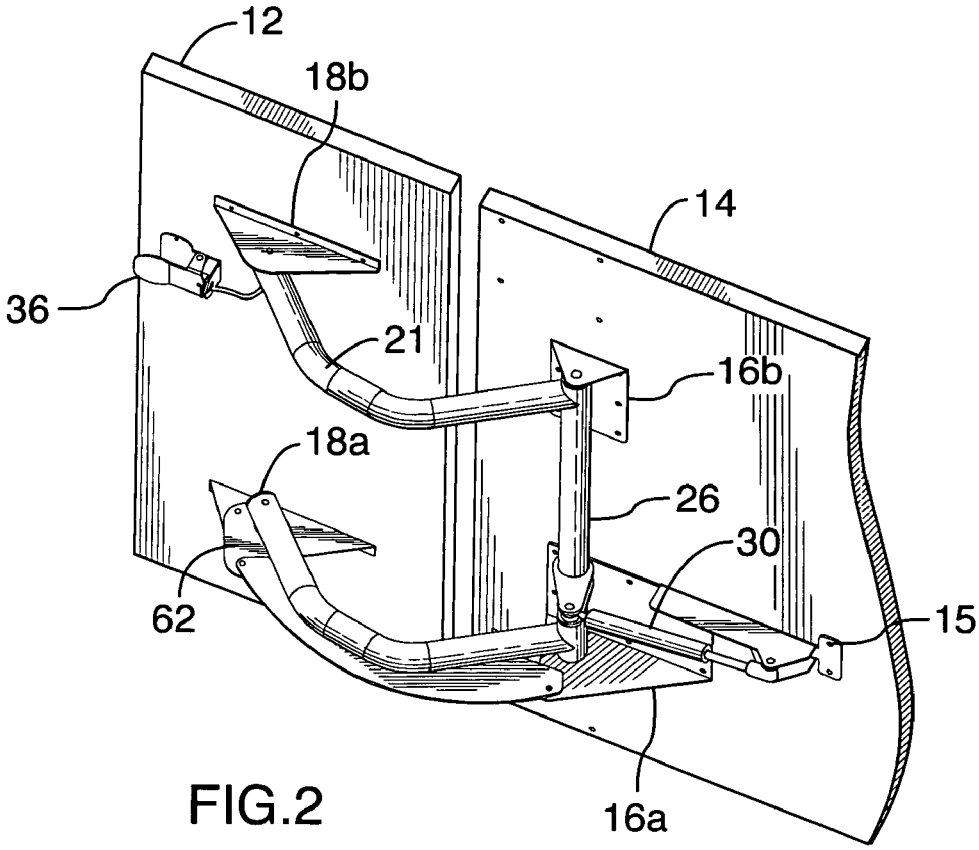
FIG. 2 is another perspective view of the adjustable work surface support of FIG. 1.

Turning to FIG. 2, a second perspective view of the work surface support 10 is shown.

Although shown in FIGS. 1 and 2 as a single bracket 16*a*, it will be understood by one skilled in the art that the mounting bracket 16*a* may be of two-piece construction. The one-piece construction of the bracket in the preferred embodiment provides more load bearing capabilities for the primary work surface 10 than a two-piece bracket. A fastening plate 15 is located at one end of the bracket 16*a* to hold it in place against the primary work surface 14.

Figure 3:
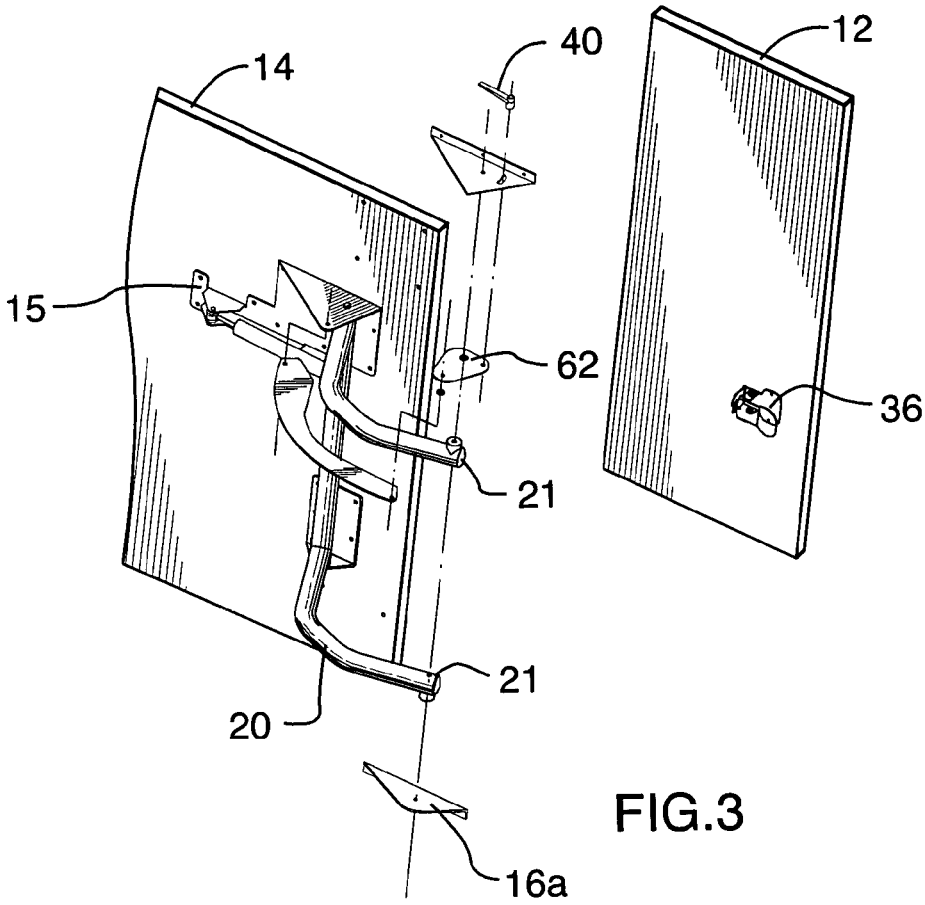
FIG. 3 is an exploded view from below of the work surface support mechanism.

Turning to FIG. 3, an exploded view of the work surface support 10 is shown.

Figure 4:
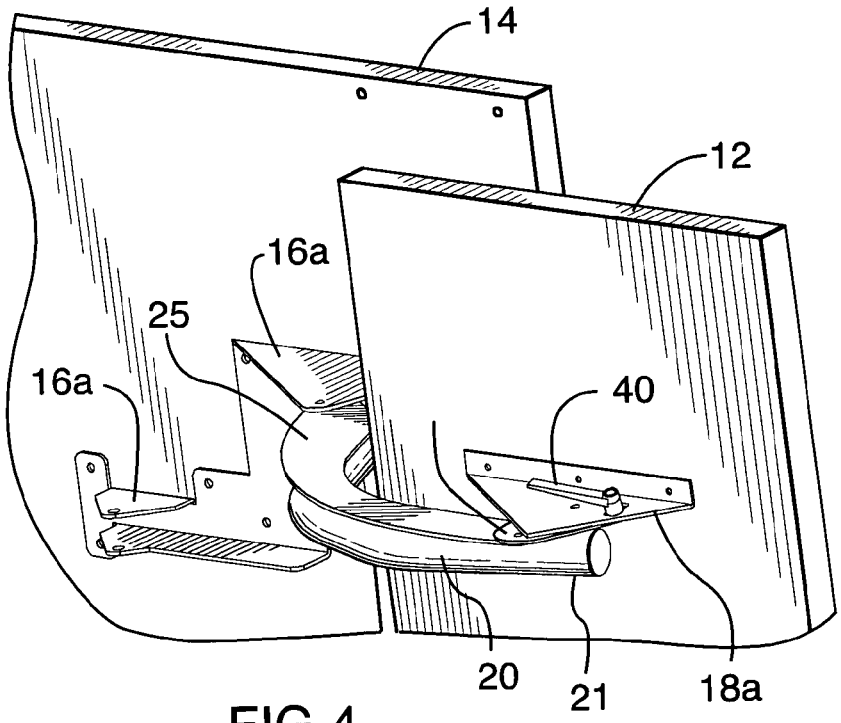
FIG. 4 is a detailed perspective view of part of the work surface support with a secondary work surface in a lowered position.

Turning to FIG. 4, a perspective view of part of the work surface support in the lowered position is shown.

As can be seen in FIG. 4, the secondary work surface 12 is in a position lower than the primary work surface 14 (the lowered position), however, the secondary work surface 12 remains parallel to the primary work surface 14 due to the connecting plate 25

Figure 5:
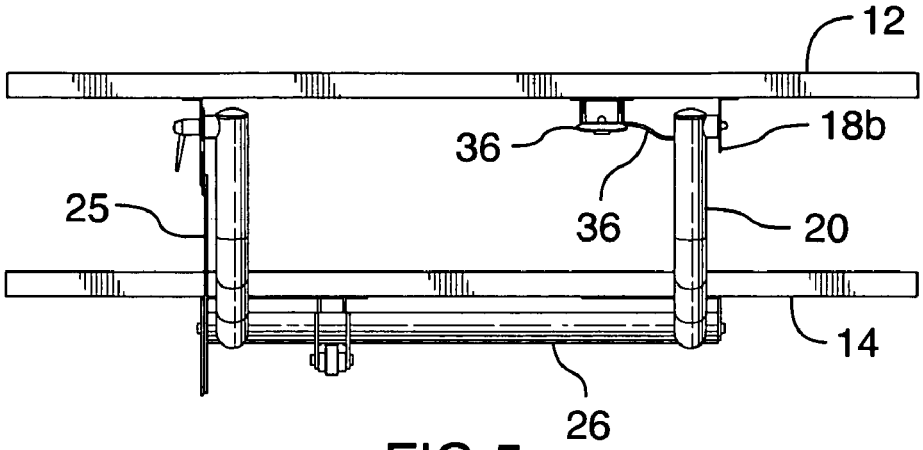
FIG. 5 is a front view of the work surface support with the secondary work surface in a raised position.

FIG. 5 provides a front view (from a user's perspective) of the work surface support 10 with the secondary work surface 12 in the raised position. As can be seen in the Figure, rotation of the support 20 about the first axis causes the tubular arms 21 to rotate about the first axis and moving the secondary work surface 12 with respect to the primary work surface 14.

The presence of tubular arms results in non-bending parts which means that user's fingers or legs will preferably not get caught during movement of the secondary work surface 12. Furthermore, there is little space between the connecting plate 25 and the arm 21*b* in which a user's fingers may be inserted, possibly causing injury.

As can be seen, an end of the cable 37 from the brake mechanism 30 is connected to the remote control mechanism 36. The depression/activation of the remote control mechanism causes the brake mechanism to release and therefore allow movement of the secondary work surface 12 with respect of the primary work surface 14.

The general range for the position of the secondary work surface 12, with respect to the primary work surface 14, is approximately eight inches above and seven inches below, however, a larger range may be appreciated with the work surface support 10 of the present invention.

Figure 6:
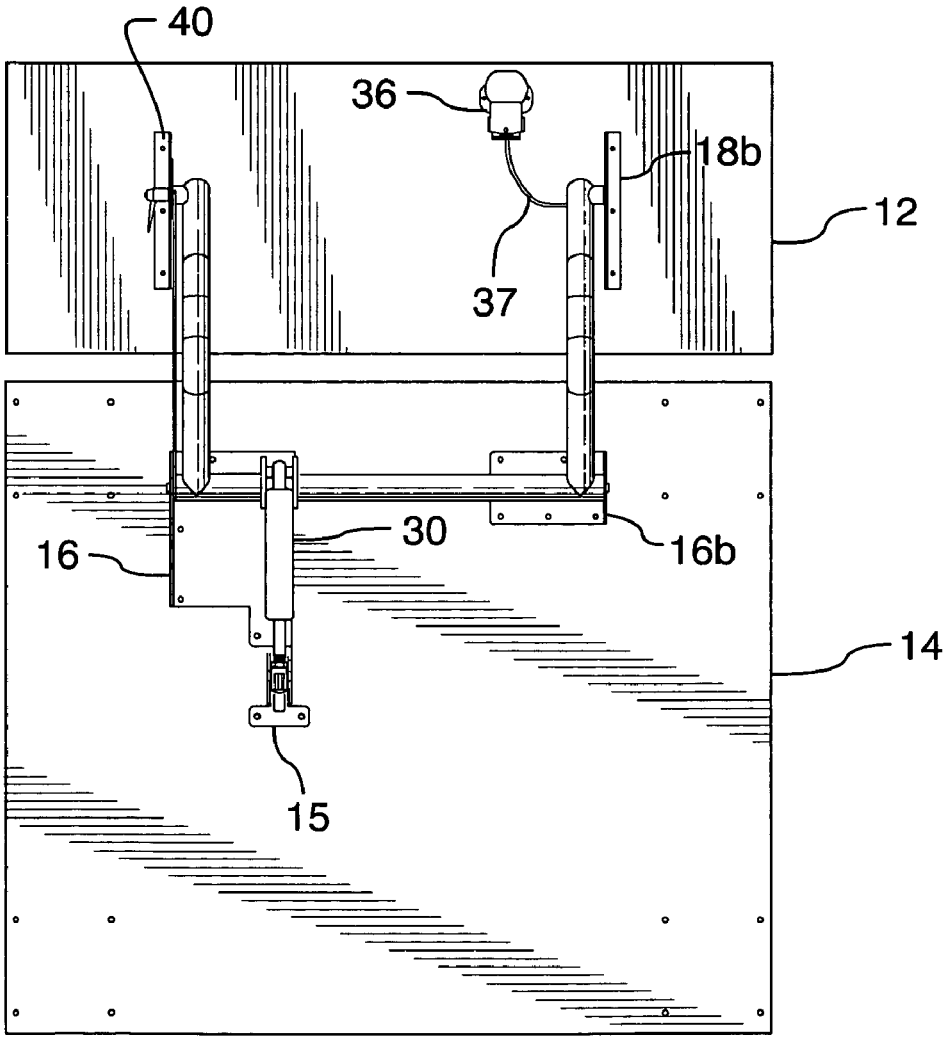
FIG. 6 is a bottom view of the work surface support.

FIG. 6 is a bottom view of the work surface support which illustrates the parallel nature of the arms 21 of the double arm support 20. In this Figure, the secondary work surface 12 is in the default position with respect to the primary work surface 14. The mounting brackets 16 and 18 are preferably mounted to the primary and secondary work surfaces, respectively, via fasteners 50 such as screws.

In operation, the brake mechanism 30 is released allowing the cross-bar 26 to rotate about the first axis and the two arms 21 to move in unison to move the secondary work surface 12 to its desired position.

Figure 7:
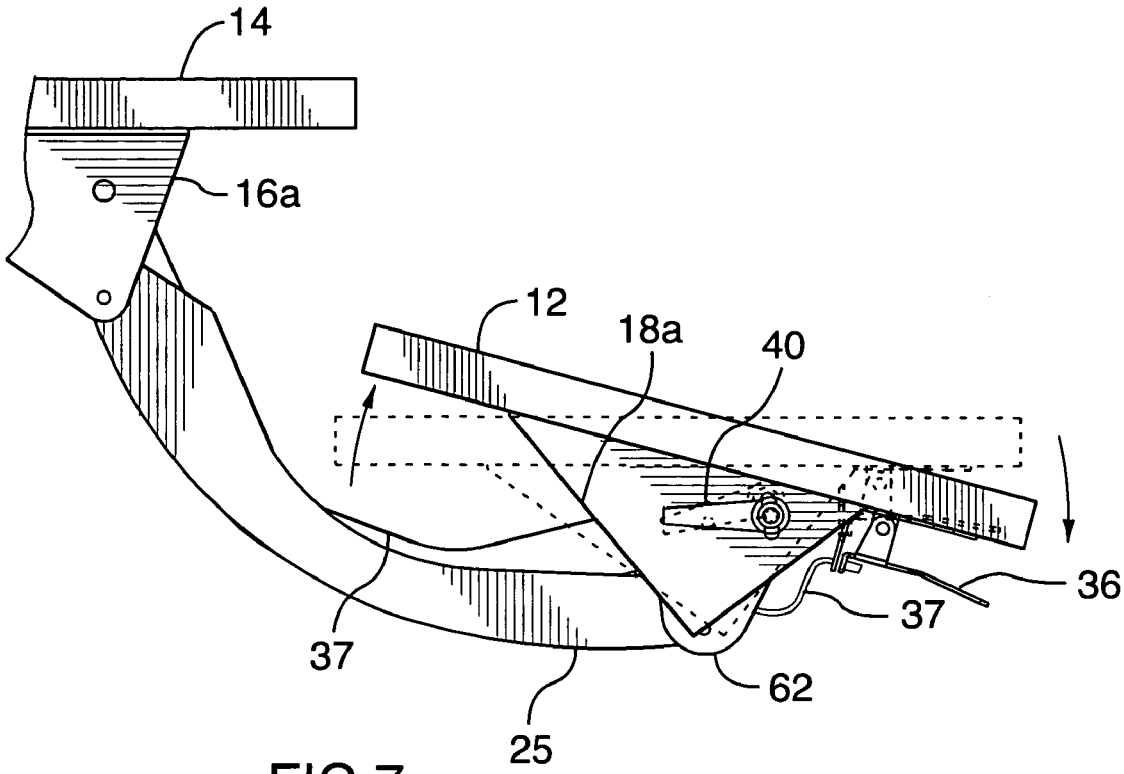
FIG. 7 is a side view of the works surface support with the secondary work surface in the lowered and tilted position.

Turning to FIG. 7, a view of the secondary work surface 12 in the lowered position with the table top of the secondary work surface tilted is shown.

The secondary work surface 12 is tilted when the tilting mechanism 40 is released. This is preferably achieved via a bolt (not shown) in a third mounting bracket 62 which moves through a slot 54 in one of the second mounting brackets 18 when the tilting mechanism 40 is released. When the tilting mechanism is engaged or tightened, the table top of the secondary work surface 12 is locked into place.

The tilting mechanism 40 allows for the plane of the secondary work surface to be tilted towards the user so that they may have easier access to the secondary work surface 12. In the example of a computer desk, it is easier for a user to type on the keyboard which is directed towards them rather than on a flat horizontal surface. The default position of the secondary work surface 12 is shown in dotted line while one tilted position of the secondary work surface is shown in solid line. The arrows 60 indicate the direction in which the secondary work surface 12 moves from the default to the tilted position shown.

As described before, the connecting plate 25 maintains the parallel relationship between the primary and secondary work surfaces 14 and 12. The parallel nature of the two work surfaces is not defined by table top working surfaces but by the positions of the primary and secondary work surface connecting means 16 and 18 with respect to each other after the secondary work surface 12 has been moved.

Figure 8:
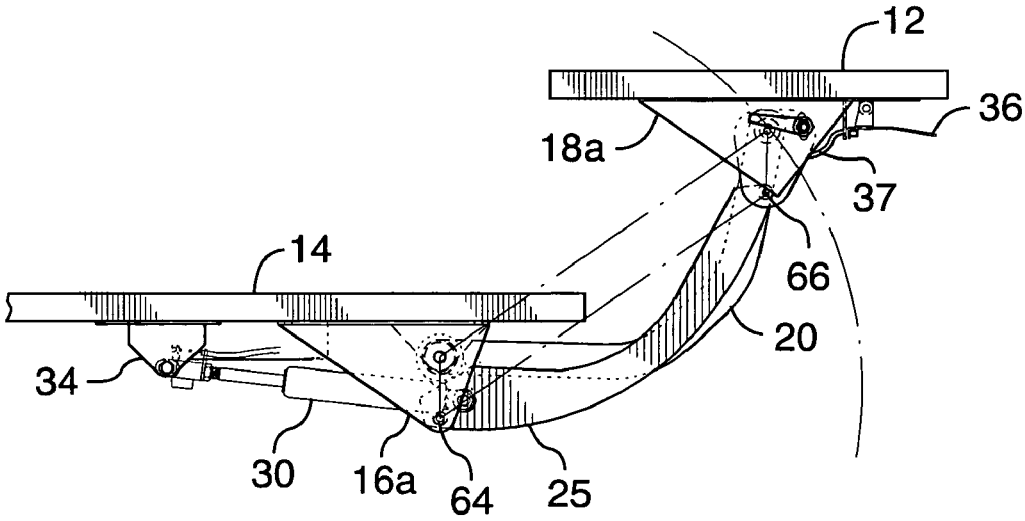
FIG. 8 is a side view of the work surface support with the secondary work surface in the raised position.

Turning to FIG. 8, a side view of the work support surface 10 with the secondary work surface 12 in the raised position is shown. As once again shown, the connecting plate 25 maintains the parallel relationship between the first and second axis (the connecting means) of the two work surfaces 12 and 14. As discussed above, the secondary work surface 12 moves relative to the primary work surface 14 after the brake mechanism 30 has been released or disengaged. In order to lock the secondary work surface 12 in place, the brake mechanism is then relocked or engaged.

Figure 9:
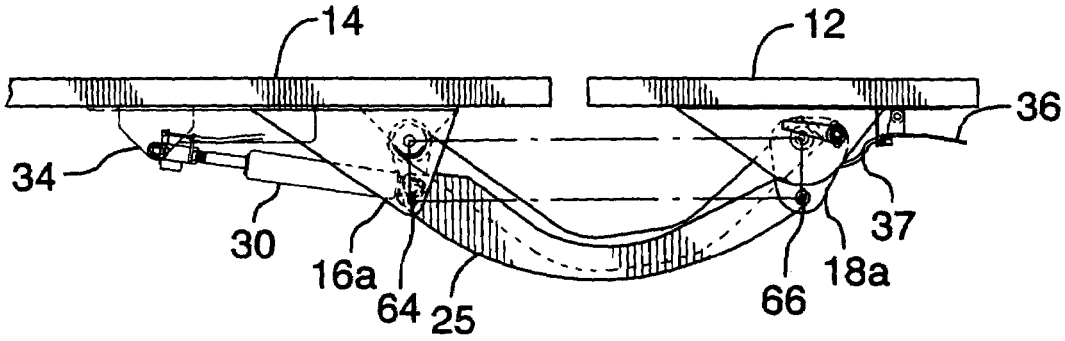
FIG. 9 is a side view of the work surface support with the secondary work surface in a level position.
Figure 10:
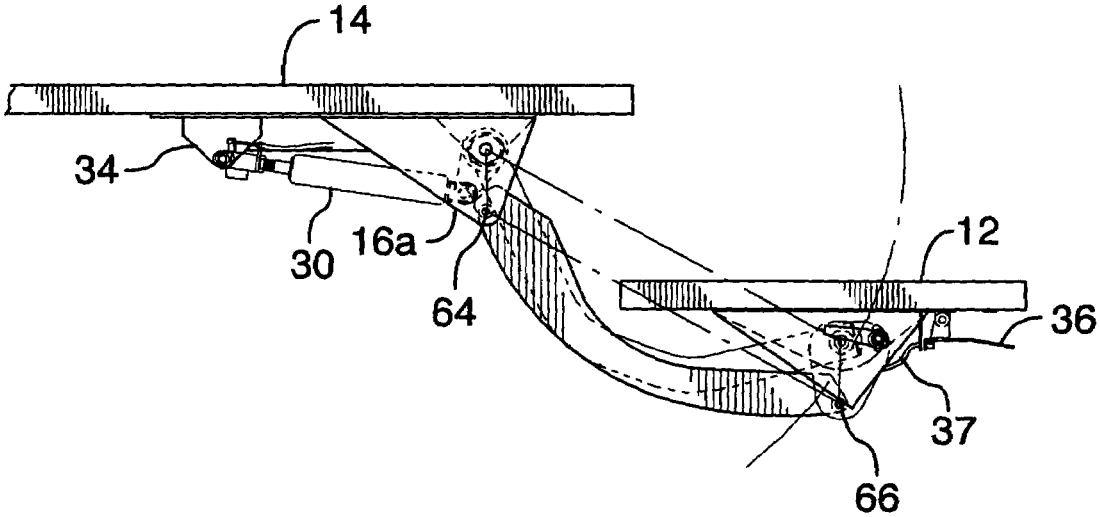
FIG. 10 is a side view of the work surface support with the secondary work surface in the lowered position.

Turning to FIG. 9, a side view of the secondary work surface 12 in the default position is shown while FIG. 10 is a side view of the secondary work surface 12 in a lowered position. In each of FIGS. 8 to 10, a dashed square indicates the relative relationships between the support brackets 16 and 18 of the primary 14 and secondary 16 work surfaces respectively to indicate the parallel relationship which is maintained between the primary and secondary work surfaces when the secondary work surface is moved. In FIGS. 8 and 10, the dashed arc which runs through the secondary work surface 12 represents a preferred travel path for the secondary work surface 12 when it moves relative to the primary work surface 14.

A further discussion is now provided regarding the parallelism provided by the connecting plate 25. In order to maintain the secondary work surface 12 in parallel relative to the primary work surface 14 as has been set by the user, the parallelogram linkage system is utilized. The connecting plate 25 is arranged adjacent to one of the double arms 21. The connecting plate 25 is pivotably attached at a first end to one of the first mounting brackets 16*b* and at a second end to the third mounting bracket 62, which is sandwiched between the connecting plate 25 and the secondary mounting bracket 18*a*. The arm 21*a* is mounted to the secondary mounting bracket 18*a* through the third mounting bracket 62. The first axis, or pivot point 64 of the primary work surface 16, the second axis, or pivot point 66 the secondary work surface 14 and the connecting plate 25 form a parallelogram, which allows the cross-bar and the arms 21 to move through their respective axes of rotation while holding the secondary work surface 12 at a constant relative to the primary work surface 14. When the arm 21*a* is rotated about the first axis, the connecting plate 25 translates with the arm 21*a* and rotates around its two pivot points. The connecting plate 25 is preferably of a similar shape as the arms of the double arm support so the connecting plate 25 does not impede with the movement of the arms 21 through the first axis of rotation of the support.

Figure 11:
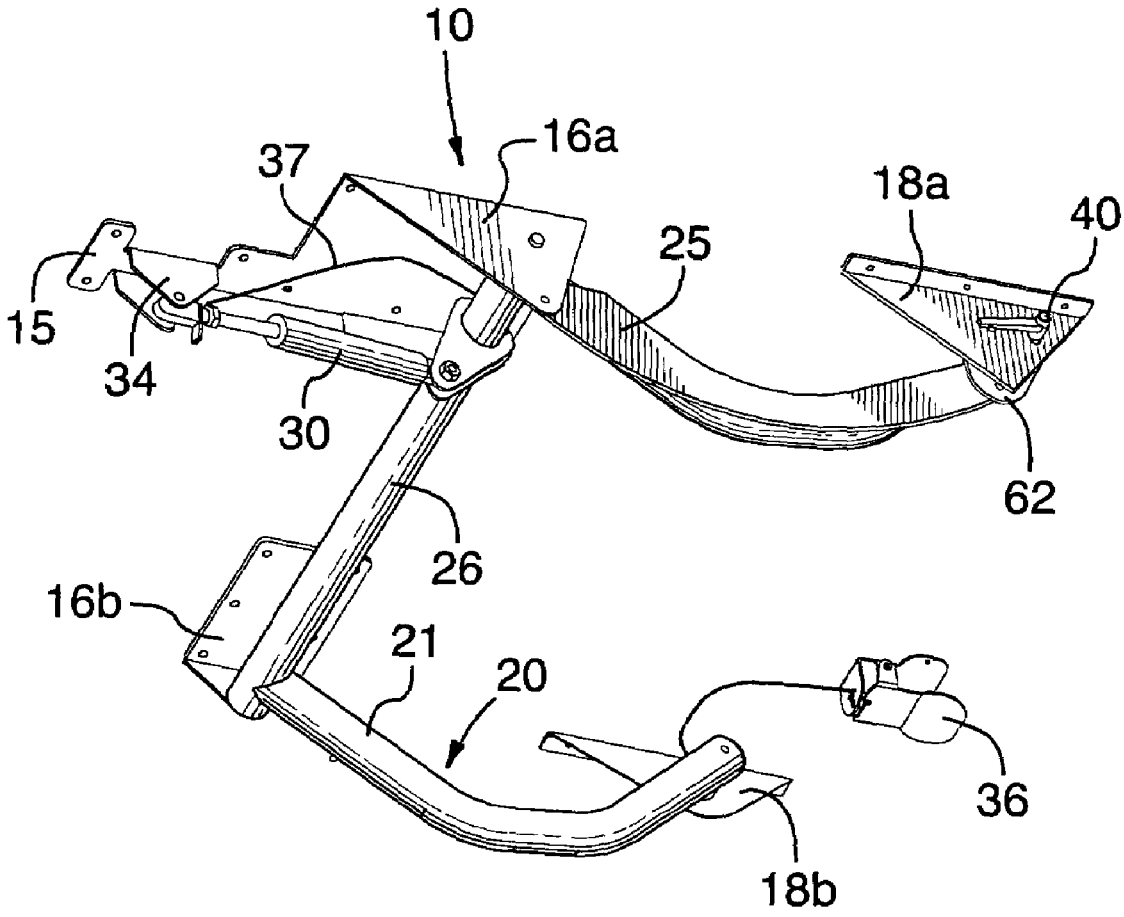
FIG. 11 is a perspective view of the work surface support.

FIG. 11 is a schematic diagram of the work surface support without the primary and secondary work surfaces. This simply provides a clearly view of an embodiment of the present invention.

Other brake mechanisms which are contemplated include spring brakes or gas cylinder brakes, especially counterbalanced brake arrangements. The counterbalancing feature constrains the downwards motion of the arm, and thus of the attached secondary work surface, when the brake mechanism is released.

An advantage of the present invention is that by having tubular arms, the presence of pinch points (locations where user's fingers may be caught or pinched between parts) is reduced/removed. Therefore, there is little opportunity that a user's fingers could get caught between the arm 21*a* and the plate 25. This allows the preferred embodiment of the work surface support to be used by youth as well as adults.

In another advantage of the present invention, the range of motion between the lowest position and the highest position of the secondary work surface with respect to the primary work surface is not restricted. By extending the length of the arms, a wider range may be appreciated.

The above-described embodiments of the invention are intended as examples only. Alterations, modifications and variations may be effected to the particular embodiments by those of skill in the art without departing from the scope of the invention, which is defined solely by the claims appended hereto.

What is claimed is:

1. An adjustable work surface support for use with a primary work surface and a secondary work surface comprising:
- a primary work surface connector;
- a secondary work surface connector;
- a parallelogram link support comprising
  - a support bar having first and second ends, said support bar pivotally mounted to said primary work surface connector to define a first axis; and
  - a pair of parallel tubular arms, each arm fixedly attached at one end to said support bar, inward from the ends of said support bar, and a pivotally attached to said secondary work surface connector to define a second axis;
- a connecting plate having first and second ends, attached adjacent one of said parallel tubular arms to said primary and secondary work surface connectors, respectively, and, having a first pivot point rotatable about said first axis and a second pivot point being rotatable about said wherein the first end of the connecting plate is positioned between the primary work surface connector and said one tubular arm;
- such that when the pair of parallel tubular arms and support bar are pivoted about said first axis, an angular position of said secondary work surface with respect to said primary work surface is substantially constant.

2. The adjustable work surface support of claim 1 further comprising a locking mechanism to selectably prevent or permit rotation of said arms and said connecting plate.

3. The adjustable work surface support of claim 2 wherein said locking mechanism is a braking mechanism.

4. The adjustable work surface support of claim 3 wherein said braking mechanism is selected from the group consisting of a gas cylinder actuated cable system, spring brakes and counterbalanced gas cylinder brakes.

5. The adjustable work surface support of claim 1 wherein said primary work surface connector is a set of mounting brackets.

6. The adjustable work surface support of claim 1 wherein said secondary work surface connector is a set of mounting brackets.

7. The adjustable work surface support of claim 1 further comprising a tilting mechanism for allowing an angle of said secondary work surface to be changed.

* * * * *